US011124335B1

(12) United States Patent
Mahan

(10) Patent No.: US 11,124,335 B1
(45) Date of Patent: Sep. 21, 2021

(54) AUTO LOCK LID

(71) Applicant: Frederick Mahan, Bristolville, OH (US)

(72) Inventor: Frederick Mahan, Bristolville, OH (US)

( * ) Notice: Subject to any disclaimer, the term of this patent is extended or adjusted under 35 U.S.C. 154(b) by 0 days.

(21) Appl. No.: 17/079,648

(22) Filed: Oct. 26, 2020

Related U.S. Application Data

(60) Provisional application No. 63/014,364, filed on Apr. 23, 2020.

(51) Int. Cl.
*B65D 43/02* (2006.01)

(52) U.S. Cl.
CPC ..... *B65D 43/0249* (2013.01)

(58) Field of Classification Search
CPC ..... B65D 43/0249; B65D 43/0212; B65D 41/16; B65D 85/12; B65D 47/265; B65D 51/28; A47G 19/2205
USPC ..... 220/260, 210, 302, 788; 229/404; 264/500
See application file for complete search history.

(56) References Cited

U.S. PATENT DOCUMENTS 4,553,667 A * 11/1985 Hudson ..... A63B 47/007 206/315.9
4,836,256 A * 6/1989 Meliconi ..... H01H 9/0242 206/523
5,092,459 A * 3/1992 Uljanic ..... H01H 9/0242 200/302.2
5,129,531 A * 7/1992 Beck ..... B65D 41/48 215/256
5,137,260 A * 8/1992 Pehr ..... B65D 43/164 215/216
5,316,141 A * 5/1994 Jalomo ..... B65D 5/20 150/128
5,499,713 A * 3/1996 Hutter ..... H01H 9/0242 206/320
5,638,976 A * 6/1997 Arnold ..... B65D 43/0231 215/330
5,648,757 A * 7/1997 Vernace ..... G08B 21/24 206/305
5,671,856 A * 9/1997 Lisch ..... A01K 97/06 206/519
5,873,456 A * 2/1999 Hull ..... H01H 9/0242 206/38.1
5,931,332 A * 8/1999 Mygatt ..... B65D 1/00 220/270
5,938,062 A * 8/1999 Paramski ..... B65D 51/246 220/254.9
5,967,350 A * 10/1999 Jones ..... B65D 41/06 116/309

(Continued)

*Primary Examiner* — Robert J Hicks
*Assistant Examiner* — Tia Cox
(74) *Attorney, Agent, or Firm* — Brennan, Manna & Diamond, LLC

(57) ABSTRACT

The present invention relates generally to the field of closure devices for consumer products, including both liquid and dry products. More specifically, the present invention relates to a lid or closure for consumer goods packaging that provides a secure locking engagement to prevent spilling, leakage, and/or tampering of the contents of the packaging. The unique closure device utilizes a combination of a release tab and locking elements, which cooperate with one another in order to seal or unseal at least a portion of the lid or closure to allow for dispensing of the contents of the container.

11 Claims, 2 Drawing Sheets

(56) References Cited

U.S. PATENT DOCUMENTS 6,056,144 A * 5/2000 Strange ..... B65D 43/0212 220/297
6,364,152 B1 * 4/2002 Poslinski ..... A47J 36/10 215/270
6,851,569 B2 * 2/2005 Conti ..... B65D 25/32 220/297
6,969,607 B2 * 11/2005 Minton ..... C12M 23/10 435/288.3
7,198,170 B2 * 4/2007 Herr ..... B65D 41/06 220/293
9,056,698 B2 * 6/2015 Noer ..... B65D 43/0208
9,114,920 B1 * 8/2015 Edelman ..... B65D 51/2814
9,873,322 B2 * 1/2018 Frank ..... B60K 15/0409
10,782,013 B1 * 9/2020 Cowen ..... F21V 33/0084
2003/0085228 A1 * 5/2003 Oakes ..... B65D 43/021 220/302
2003/0127345 A1 * 7/2003 Zuleta ..... H01H 9/0242 206/320
2003/0136790 A1 * 7/2003 McNeeley ..... B65D 43/164 220/793
2006/0124482 A1 * 6/2006 Hodges ..... H01H 9/0242 206/320
2007/0141126 A1 * 6/2007 Hudson ..... A41D 31/305 424/443
2008/0190528 A1 * 8/2008 Steinberg ..... H01H 9/0242 150/165
2008/0302794 A1 * 12/2008 Wagner ..... B65D 55/145 220/210
2009/0038721 A1 * 2/2009 Wakitani ..... A63F 13/02 150/154
2010/0062075 A1 * 3/2010 Schinder ..... A01N 59/16 424/618
2010/0102084 A1 * 4/2010 Clark ..... H01H 9/0242 222/80
2011/0025933 A1 * 2/2011 Schindler ..... C09D 5/14 348/843
2014/0138381 A1 * 5/2014 Letica ..... B65D 55/02 220/265
2014/0353201 A1 * 12/2014 Molineux ..... A45C 11/00 206/524.3
2015/0196149 A1 * 7/2015 Savenok ..... B65D 85/72 220/577
2016/0067134 A1 * 3/2016 Moon ..... A61G 13/02 5/600
2016/0270573 A1 * 9/2016 Chiang ..... B65D 47/0857
2018/0057226 A1 * 3/2018 Austin ..... B65D 43/0208
2019/0062009 A1 * 2/2019 Georgiadis ..... B65D 50/046

* cited by examiner

AUTO LOCK LID

CROSS-REFERENCE TO RELATED APPLICATION

The present application claims priority to, and the benefit of, U.S. Provisional Application No. 63/014,364, which was filed on Apr. 23, 2020, and is incorporated herein by reference in its entirety.

BACKGROUND OF THE INVENTION

The present invention relates generally to the field of closure devices for consumer products, including both liquid and dry products. More specifically, the present invention relates to a lid or closure for consumer goods packaging that provides a secure locking engagement to prevent spilling, leakage, and/or tampering of the contents of the packaging. The lid or closure may be used for takeaway products, such as coffee, tea, soda, soup, and other convenience type food products intended to be consumed on-the-go, or for those products that are sold in portable containers and for single-use application. In addition, the lid system may be used for other application areas, such as medical, pharmaceutical, and other situations where secure and non-leaking dispensing of the contents is needed. As previously stated, the present invention is applicable to liquids, gases and dry solid products, and the dry products may take the form of powdered or particulate material, i.e. for dispensing cereal for eating or dispensing laundry or dish detergent when used in cleaning. Accordingly, the present specification makes specific reference to the presently described invention. However, it is to be appreciated that aspects of the present invention are also useable with other like applications, devices, and methods of manufacture.

Today, most lids that are applied to convenience packaging can take several forms, including a lid that is placed over the top of the cup and sits on top of the cup. Other container-sealing configurations include placing a foil or plastic film over the opening of the container to prevent the contents from spilling out of the container. The problem with such solutions is that the lid can be easily displaced when the cup tips over, or is jostled, bumped, etc. In addition, problems arise when the lid is not fully secured to the top of the cup or container, and when the individual seeks to use or enjoy the contents of the cup, the lid falls off, and the contents of the cup are spilled on the individual or in the area where the user was intending to dispense the contents.

Further, during the last several years, the problems inherent in having food, beverage and non-prescription drug items removed from store shelves for the purpose of introducing poisons or other foreign substances into the item, with the item being replaced on the store shelf for purchase by an unsuspecting customer, has received wide-spread media attention, as well as industry-wide recognition as a continuing problem. Other similar issues that have also received national media attention include childhood pranks whereby an adolescent goes into a store, removes the covering or lid off of a product, consumes part of the product and then returns the same to a shelf.

Therefore, there exists a long felt need in the art for an improved closure system for convenience and single-serve or single-use packaging. More particularly, there is a long felt need in the art for a secure locking closure system that reduces the risk of spills when the lid or cover prematurely or accidentally unseals from the cup, vessel, or container. In addition, there is a long felt need in the art for an integral secure closure system that also indicates to the user whether the contents have been tampered with prior to use or consumption. Finally, there is a long felt need in the art for an improved closure system for a cup or container that is relatively inexpensive to manufacture, and that is safe and easy to use.

In one exemplary embodiment of the presently described invention, a closure system for a container is described and includes a container that has a base and a body portion extending upwardly from the base portion. The base portion forms a closed end of the body portion and extends around the lower perimeter of the body portion. The system further includes a top end forming an opening for the body portion, with the top end having a ridge that extends along an upper perimeter of the body portion. A closure is provided that has a base portion, sidewall and a top portion. The base portion has a perimeter that mates with the upper perimeter of the body portion and top end. The closure includes at least one release tab disposed on the base portion of the closure, and the sidewall extends generally circumferentially around the base.

In this manner, the improved closure system for a container of the present invention accomplishes all of the foregoing objectives, and substantially departs from the concepts and designs of the conventional closure systems used with single-use or single-serve packaging.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The present invention relates to closure systems for single-use or single-serve containers. As used herein, the term "containers" refers to cups, bags, boxes, bowls, crates, cartons, vessels, pouches, sacks, and the like. "Containers" are typically used for holding consumer products, both those intended for human consumption (e.g. coffee, tea, medicines) and those for home or office use, such as with laundry, cleaning liquids, or dishwashing detergent. However, the closure system of the present invention is not so limiting, and may be used for any other purpose that may satisfy the needs and/or preferences of the user. More specifically, the novel closure system of the present invention provides for a locking engagement between the lid and container, as well as a release tab that allows a user to flex the lid and locking channel to remove the lid from the container, and to release and/or use the contents of the container.

In one exemplary embodiment of the presently described invention, a closure system for a container is described and includes a container that has a base and a body portion extending upwardly from the base portion. The base portion forms a closed end of the body portion and extends around the lower perimeter of the body portion. The system further includes a top end forming an opening for the body portion, with the top end having a ridge or other protrusion that extends along an upper perimeter of the body portion for mating engagement with a closure. The closure of the present invention is preferably comprised of a base portion, a sidewall and a top portion. The base portion has a perimeter that mates with the upper perimeter of the body portion and top end, and the sidewall extends generally circumferentially around the base, and from the base to the top portion. The closure is further comprised of at least one release tab disposed on the base portion of the closure, and easily grabbable by a user.

In a still further exemplary embodiment of the presently described invention, a lid is provided for single-use or single-serving containers. The lid is preferably comprised of a top portion, a sidewall, and a base portion. The sidewall is connected to the top portion along a top edge and the base portion along a bottom edge. The base portion has an inverted channel formed from a lip that extends generally downwardly from the base portion (i.e., in the general direction of the container), and is intended to fit inside a container rim. The lid further comprises a flange portion that is intended to fit outside a container rim, and the lip and the flange are connected to one another by an inverted channel, which is positioned over the container rim. The flange has at least one release tab for flexing the inverted channel in an effort to release the lid from the container rim when the purchaser or other user desires to access the contents of the container is a secure and spill-proof manner.

In yet a further exemplary embodiment of the presently described invention, a single-use container and lid combination is presented. The container portion is preferably comprised of a base portion, a side wall, and a top portion. The top portion has a rim extending circumferentially around a top edge of the sidewall, and creates an open end. The sidewall extends upwardly from the base portion, and the base portion forms a sealed end at the bottom edge of the side wall of the single-use or single-serving container. As stated, a lid for sealing the container is also provided, and is preferably comprised of a top, a sidewall connected to the top along a top edge and extending downwardly from the top, a lip, and a flange. Each of the lip and the flange are connected to one another (e.g., integrally formed) by an inverted generally U-shaped channel, with the inverted and generally U-shaped channel being sized and configured to fit over the rim of the top edge of the side wall. At least one release tab is provided on the flange, and at least one locking tab is provided on the rim, both easily grabbable by a user. The locking tab engages the flange of the lid to secure it to the container (i.e., to make the container relatively tamper-proof) until such time that the user or purchaser desires to access the contents of the container. As used herein, the term "tamper-proof" does not necessarily mean that an unauthorized person won't be able to access the contents of the container. Rather, it means that any such unauthorized accessing of the container will be clearly visible to the store owner, worker, prospective purchaser, or any other this person.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed, and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
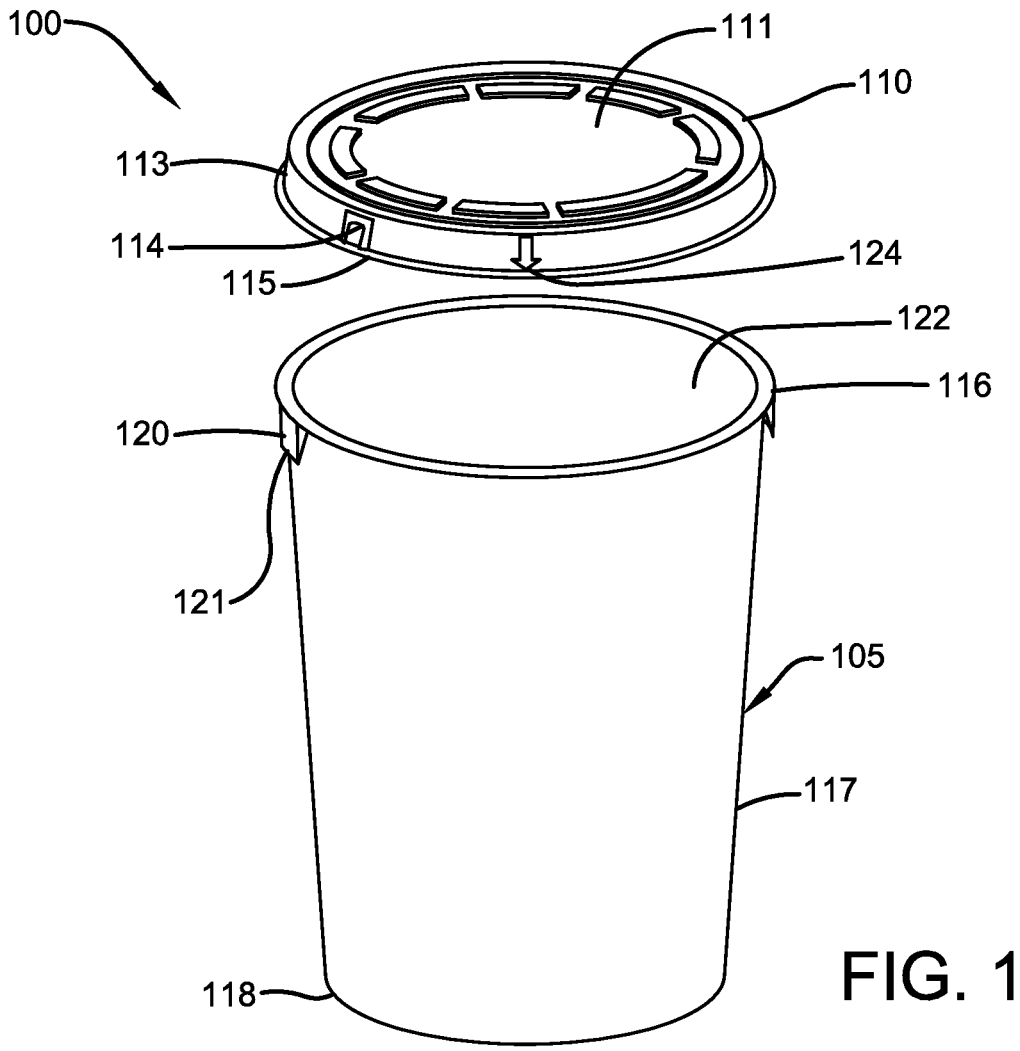
FIG. 1 illustrates a side elevational and partially exploded view of one potential embodiment of the container and closure system of the presently described invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As previously stated, there is a long felt need in the art for an improved closure system for use with single-serve or single-use packaging. More particularly, there is a long felt need in the art for a secure locking closure system that reduces the risk of spills when the lid or cover prematurely or accidentally unseals from the cup, vessel, or container, such as when the container is bumped, jostled or dropped. In addition, there is also a long felt need in the art for an integral secure closure system that indicates to the user whether the contents of the container has been tampered with prior to use or consumption. Finally, there is a long felt need in the art for an improved closure system for a cup or container that is relatively inexpensive to manufacture, and that is safe and easy to use.

The containers, such as cups, tubs, bowls, bottles, flasks, and the like for use with the present invention, are preferably for the single-use or convenience type of containers. Such containers are found, for example, in use at fast food or convenience stores, supermarket or grocery stores, and other retail environments where an individual may purchase a "to-go" or takeaway product for consumption of the contents of the container, such as coffee, tea, soda, cereal, or the like. In addition to these takeaway or single use type products, the packaging of the present invention may also be used for medical, pharmaceutical, and other household applications, such as with the dispensing of detergent, soap, other cleaning solutions, or the like.

Containers, packages, or vessels as used with the present invention may be made from a variety of materials, including paper, polyethylene or wax-coated paper, post-consumer waste materials, polyethylene, polystyrene, paperboard, cardboard, biodegradable materials, renewable materials, and combinations of these materials. The closures or lids for these types of containers may also be made from a variety of materials, including those listed above, as well as foils and heat-sealable films. More commonly, lids and closures are made from plastic materials, such as polyethylene or polystyrene.

Reference is now directed to FIG. 1, which illustrates a side elevational and partially exploded view of one potential embodiment of the container and closure system 100 of the presently described invention in accordance with the disclosed architecture. More specifically, the beverage cup and lid combination 100 is comprised of a container 105 and a lid 110. The lid 110 is further comprised of a top portion 111, a sidewall 113 and a lower portion 115, wherein the lower portion is attached to (e.g., integrally formed with) the bottom edge of the side wall 113. At least one release tab 114 is provided in a portion of the sidewall 113 to enable an individual user to grip the release tab 114 and flex the sidewall 113 outwardly (i.e., away from the container 105) when the lid 110 is in proper position over the container 105. The lid 110 may also contain a trademark, trade name, or other indicia 124, as well as directions for both use of the container and lid combination 100 and how to release the lid 110 from the top of the container 105.

The container 105 is preferably comprised of a sidewall 117, a base 118, and a top portion 116, which provides an open end 122 to allow for both the filling of the container 105, as well as for draining the contents of the container 105. FIG. 1 further illustrates one potential embodiment of a locking tab 120, which may be attached to the top portion 116 of the container 105, and will lock the lid 110 onto the rim top portion 116 of the container 105 when the lid 110 is properly positioned on top of the container 105. The locking tab 120 may be made from the same materials as the container 105 and/or lid 110, or may be made from a different material. For example, wherein the container 105 may be comprised of a polyethylene-coated paper, the locking tab 120 may be an extruded polyethylene component that is added to the container 105 during the manufacturing of the container 105, or immediately thereafter by another means (e.g., via use of a food grade adhesive).

As best shown in FIG. 1, the locking tab 120 has a generally tapered shape. More specifically, the locking tab 120 may have a wider portion near the top portion 116, and then taper down to a point at the end opposite the top portion 116. By having a pointed locking tab 120, the point 121 can physically engage with the side wall 113 flange, as more fully discussed with respect to FIG. 2 below, and lock the lid 110 in a proper position over the open end 122 of the container 105, which helps to prevent or reduce the likelihood of a spill. Notwithstanding, in an alternative embodiment of the present invention, locking tab 120 may extend around the entire circumference of the top portion 111 of the container 105 so that it may engage with a corresponding flange 218/trailing edge 220, both of which also extend around the entire circumference of lid 110.

Figure 2:
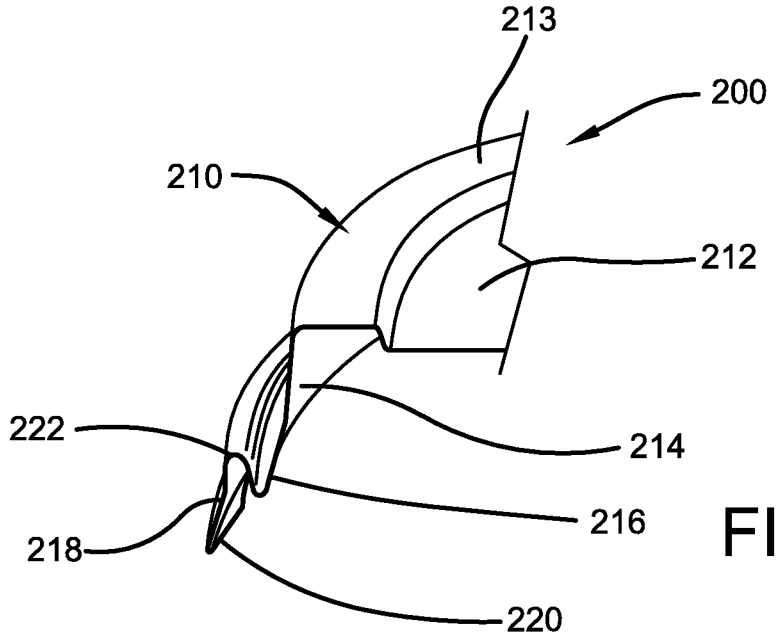
FIG. 2 illustrates a cut away view of one potential embodiment of the closure used with the container and closure system of the presently described invention in accordance with the disclosed architecture, wherein the interlocking features of the closure system are on illustration.

FIG. 2 illustrates a cut away view of one potential embodiment of the closure used with the container and closure system 100 of the presently described invention in accordance with the disclosed architecture, wherein the interlocking features of the closure system are on full display. More specifically, the container and closure system 100 is comprised of a lid 200. The lid 200 is comprised of a top portion 210, which includes a flat portion 213 and a recessed portion 212. The lid 200 is further comprised of a sidewall 214, an inside lip 216 and an external flange 218, each of which preferably extend around the entire circumference of the lid 200. The inside lip 216 is configured to fit inside the top portion rim 116 of the container 105 around the entire circumference thereof, and the flange 218 is configured to fit over the outside of the top portion rim 116 of the container 105 around the entire circumference thereof. Additionally, the flange 218 preferably extends downwardly (i.e., in the direction of the container 105) a distance greater than the lip 216 from the sidewall 214, and terminates at a trailing edge 220, the combination of which is meant to matingly engage with the lid lock tab 120. As stated above, in an alternative embodiment of the present invention, locking tab 120 is not of a finite width and may rather extend around the entire circumference of the top portion 111 of the container 105 so that can engage with the combination flange 218/trailing edge 220, both of which also extend around the entire circumference of lid 200. In this manner, a secure connection can be made around the entire, or almost the entire, circumference of container 105.

The lid lock tap 120 is preferably formed integrally with the container 105, and may be formed as part of the extrusion or mold-forming process. The flange 218 and lip 216 are also preferably integrally formed and are connected to one another by a channel 222, which as best shown in FIG. 2, is preferably a generally inverted and U-shaped channel. However, it should be understood that the channel could be any shape, such as one having corners at 90° and forming part of a square to fit over the top of the rim of the container 105. The channel is intended to fully cover the rim of the cup or container 105 and create a relatively tight and waterproof seal therewith, so that in the event the container 105 tips over, is jostled, dropped or the like, the lid-locking system of the present invention prevents the contents from spilling out of the container 105.

Figure 3:
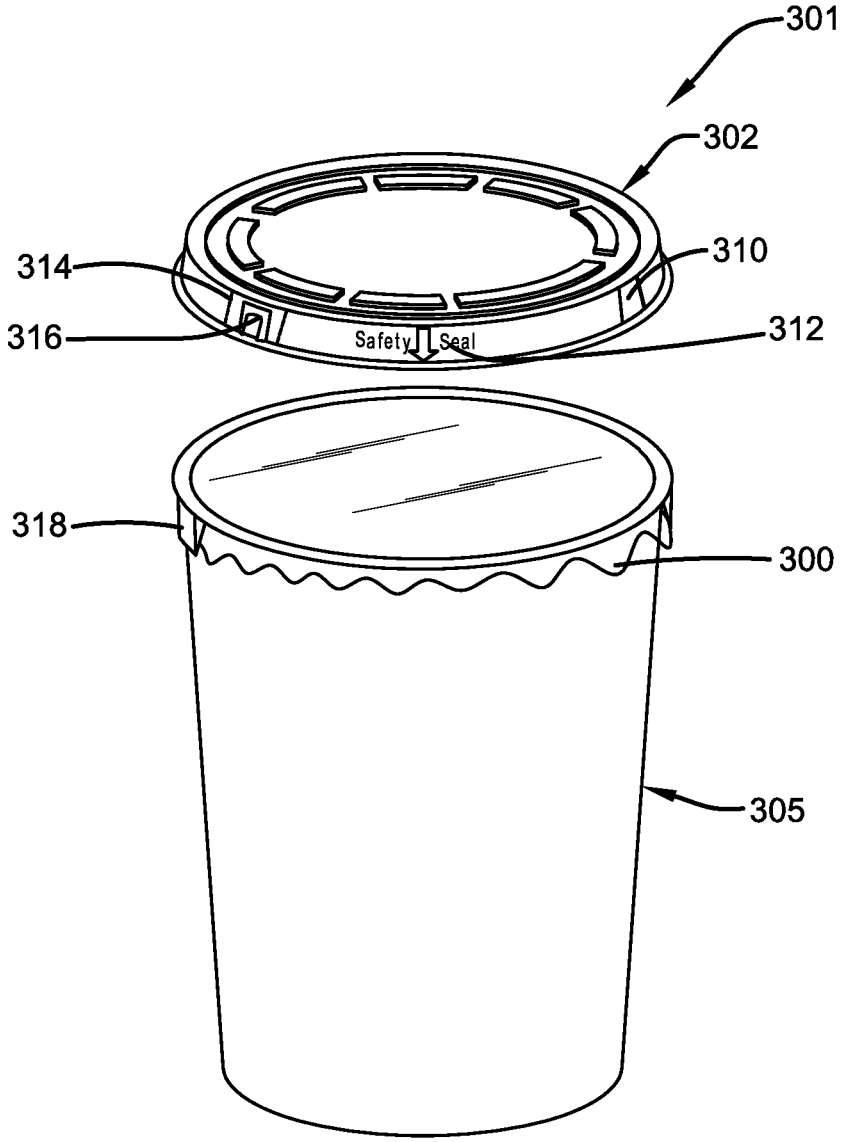
FIG. 3 illustrates a side elevational and partially exploded view of one potential embodiment of the container and closure system of the presently described invention in accordance with the disclosed architecture and having a tamper-evident system.

FIG. 3 illustrates a side elevational and partially exploded view of one potential embodiment of the container and closure system 301 of the presently described invention in accordance with the disclosed architecture and having a tamper-evident system. The container and lid combination 301 is preferably comprised of a lid 302 and a container 305, wherein the lid 302 may be repeatedly attached and detached to and from the container 305 on demand by a user to, for example, access the contents of the container 305.

In this particular embodiment, the container and closure system 301 is further comprised of a tamper-evident seal 300, such that when the lid 302 is locked to the container 305, the lid 302 cannot be removed without breaking the tamper evident seal 300. In this way, individuals can be sure that the product contained within the container and closure system 301 remains safe for use and/or consumption, and has not been tampered with. FIG. 3 also illustrates several additional (and optional) features of the container and closure system 301 including, without limitation, a dispensing area 310, which can be used for sipping the contents of the container 305 (e.g., coffee, tea, water, soda and the like), or pouring the contents of the container 305 (e.g., laundry detergent, cereal, rice, etc.). The container and closure system 301 may further comprise indicia 312, such as the trademark or trade name of the manufacturer of the product or as part of a marketing or other commemorative theme for which a person may purchase a souvenir product.

As best illustrated in FIG. 3, the release tab 316 is intended to be flexible in order to give lift to the lid 302 and separate the channel from the rim of the container 305 so that the lid 302 can be easily removed by a user when so desired. In this embodiment, release tab 316 is provided with frangible lines 314 of weakness so that in an alternate arrangement, pulling upwards (i.e., away from the container 305) on the release tab 316 will break the frangible lines 314, thereby allowing the release tab 216 to separate from the lid 302, thereby breaking the seal that the channel has with the cup or container 305. FIG. 3 also illustrates the locking tab 318 along with the tamper-evident seal 300 to illustrate that the breaking or use of the locking tab 318 will also break the tamper-evident seal 300. The locking tab 318 may also be aligned with the release tab 318.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein, "lid", "cap", and the like are interchangeable and refer to improved lid-locking system used to prevent spillage of the contents of the container of the present invention. Likewise, the term "container" can refer to many types of containers, such as cups, bags, boxes, and the like, which are referenced above.

Notwithstanding the forgoing, the components of improved and of the present invention can be of any suitable size and configuration as is known in the art without affecting the overall concept of the invention, provided that they accomplish the above stated objectives. One of ordinary skill in the art will appreciate that the size, configuration, and material of improved cup and lid-locking system 100 as shown in the FIGS. are for illustrative purposes only, and that many other sizes of components of the lid and container system 100 are well within the scope of the present disclosure.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A container closure system comprising:

a container having a base, a sidewall extending upwardly from the base wherein the base forms a closed end of the sidewall and extending around a lower perimeter of the sidewall, and a top end forming an opening for the sidewall, wherein the top end has a top portion and extends along an upper perimeter of the sidewall;

a closure having a base portion, a sidewall and a closure top portion, the base portion having a perimeter that mates with the upper perimeter of the sidewall and top end;

at least one release tab disposed on the base portion of the closure, wherein the container further comprises at least one locking element disposed on the upper perimeter of the sidewall; and a tamper indicating strip disposed over at least one of the at least one release tab or the at least one locking element.

2. The container closure system of claim 1, wherein the at least one locking element and at least one release tab are disposed in an overlapping relationship with one another.

3. The container closure system of claim 2, wherein the at least one locking element and at least one release tab cooperate with one another to release at least a portion of the closure.

4. The container closure system of claim 1, wherein the closure further comprises a dispensing area for dispensing a content of the container.

5. The container closure system of claim 4, wherein the dispensing area is less than an area of the closure.

6. The container closure system of claim 1, wherein the closure is further comprised of an inside lip and an external flange on the base portion, and further wherein the inside lip and the external flange cooperate with one another to form a seal on the upper perimeter of the sidewall.

7. The container closure system of claim 6, wherein the sidewall of the closure extends upwardly from the inside lip to the closure top portion.

8. The container closure system of claim 1, wherein the at least one locking element extends generally downwardly from the upper perimeter of the sidewall.

9. The container closure system of claim 1, wherein the container contains one of a liquid, a powder, a solid, or a gas.

10. A single use container and lid combination comprising:

a container comprised of a base portion, a sidewall and a top portion, wherein the top portion is comprised of a rim extending circumferentially about a top edge of the sidewall and creating an open end, and further wherein the base portion and the sidewall form a sealed end at a bottom edge of the sidewall, and the sidewall extends upwardly from the base portion;

a lid for sealing the container, the lid comprised of a top, a sidewall connected to the top along a top edge and extending downwardly from the top, and a lip and a flange connected to one another by an inverted U-shaped channel, the inverted U-shaped channel being sized and configured to fit over the rim of the top edge of the sidewall of the container; and at least one release tab provided on the flange and at least one locking tab provided on the rim of the container with the locking tab engaging the flange to hold the lid securely to the container, wherein the locking tab has a pointed end to grip the flange portion to hold the lid in position on the container.

11. A single use container and lid combination as recited in claim 10, wherein the release tab is flexible and deforms the flange to remove the lid from the container.

* * * * *